United States Patent [19]

Keough

[11] Patent Number: 5,042,667

[45] Date of Patent: Aug. 27, 1991

[54] SORTING SYSTEM FOR ORGANIZING IN ONE PASS RANDOMLY ORDER ROUTE GROUPED MAIL IN DELIVERY ORDER

[75] Inventor: Laurence J. Keough, Fairfield, Conn.

[73] Assignee: Pitney Bowes Inc., Stamford, Conn.

[21] Appl. No.: 434,733

[22] Filed: Nov. 13, 1989

[51] Int. Cl.[5] ..... B07C 3/00

[52] U.S. Cl. ..... 209/3.1; 209/584; 209/900; 209/569

[58] Field of Search ..... 209/583, 584, 569, 900, 209/564, 565, 3.1-3.3, 552; 364/478; 382/1, 57

[56] References Cited

U.S. PATENT DOCUMENTS

| | | | |
|---|---|---|---|
| 3,184,061 | 5/1965 | Levy | 209/552 |
| 3,261,464 | 7/1966 | Levy | 209/552 |
| 3,573,748 | 4/1971 | Holme | 340/172.5 |
| 4,247,008 | 1/1981 | Dobbs | 209/569 |
| 4,388,994 | 6/1983 | Suda et al. | 209/564 |
| 4,554,873 | 11/1985 | Rex | 104/88 |
| 4,566,595 | 1/1986 | Fustier | 209/545 |
| 4,601,396 | 7/1986 | Pavie | 209/569 |
| 4,611,280 | 9/1986 | Linderman | 364/300 |
| 4,632,252 | 12/1986 | Haruki et al. | 209/900 X |
| 4,641,753 | 2/1987 | Tamada | 209/546 |
| 4,778,062 | 10/1988 | Pavie et al. | 209/900 X |

FOREIGN PATENT DOCUMENTS

| | | |
|---|---|---|
| 0099434 | 1/1984 | European Pat. Off. . |
| 0281007 | 7/1988 | European Pat. Off. . |

*Primary Examiner*—Donald T. Hajec
*Attorney, Agent, or Firm*—Charles R. Malandra, Jr.; David E. Pitchenik; Melvin J. Scolnick

[57] ABSTRACT

A one-pass sorting system for sorting mail pieces in a sequence corresponding to a mail carrier's route includes storage media for storing a database containing a delivery sequence for each address on the carrier's route. As mail pieces to be delivered by the carrier are fed into the system, each of the mail pieces are transported to an multiline optical character reader (MLOCR) which reads the address printed on the mail piece. A processor operatively connected to the MLOCR and the storage media determines the sorting sequence representative of the delivery order sequence for each of the mail pieces which are then stored in a temporary storage bin until the sorting sequence has been determined for all the mail pieces. The mail pieces are then removed from the temporary storage bin and deposited into final sorting bins in an order corresponding to a sorting scheme corresponding to the delivery sequence in the carrier's route.

10 Claims, 7 Drawing Sheets

FIG. 6

| CARRIER ROUTE STOP NUMBER | ZIP+4 | ADDRESS |
|---|---|---|
| 1 | 06430-0001 | 40 WOODBINE LANE |
| 2 | 06430-0001 | 44 WOODBINE LANE |
| 3 | 06430-0001 | 48 WOODBINE LANE |
| 4 | 06430-0003 | 50 WOODBINE LANE |
| 5 | 06430-0003 | 54 WOODBINE LANE |
| 6 | 06430-0005 | 60 WOODBINE LANE |
| 7 | 06430-0007 | 70 WOODBINE LANE |
| 8 | 06430-0007 | 76 WOODBINE LANE |
| 9 | 06430-0008 | 77 WOODBINE LANE |
| 10 | 06430-0008 | 75 WOODBINE LANE |
| 11 | 06430-0008 | 71 WOODBINE LANE |
| 12 | 06430-0872 | 100 JEFFERSON STREET |
| 13 | 06430-0872 | 104 JEFFERSON STREET |
| 14 | 06430-0872 | 108 JEFFERSON STREET |
| 15 | 06430-0862 | 109 JEFFERSON STREET |
| 16 | 06430-0862 | 107 JEFFERSON STREET |
| 17 | 06430-0862 | 103 JEFFERSON STREET |
| 18 | 06430-0006 | 63 WOODBINE LANE |
| 19 | 06430-0852 | 100 ADAMS STREET |
| 20 | 06430-0852 | 102 ADAMS STREET |
| 21 | 06430-0852 | 108 ADAMS STREET |
| 22 | 06430-0842 | 107 ADAMS STREET |
| 23 | 06430-0842 | 105 ADAMS STREET |
| 24 | 06430-0004 | 57 WOODBINE LANE |
| 25 | 06430-0004 | 53 WOODBINE LANE |
| 26 | 06430-0832 | 100 WASHINGTON STREET |
| 27 | 06430-0832 | 104 WASHINGTON STREET |
| 28 | 06430-0832 | 108 WASHINGTON STREET |
| 29 | 06430-0153 | 50 CHERRY STREET |
| 30 | 06430-0153 | 52 CHERRY STREET |
| 31 | 06430-0153 | 58 CHERRY STREET |
| 32 | 06430-0155 | 64 CHERRY STREET |
| 33 | 06430-0157 | 70 CHERRY STREET |
| 34 | 06430-0157 | 76 CHERRY STREET |
| 35 | 06430-0158 | 75 CHERRY STREET |
| 36 | 06430-0156 | 65 CHERRY STREET |
| 37 | 06430-0154 | 57 CHERRY STREET |
| 38 | 06430-0154 | 53 CHERRY STREET |
| 39 | 06430-0822 | 107 WASHINGTON STREET |
| 40 | 06430-0822 | 105 WASHINGTON STREET |
| 41 | 06430-0822 | 103 WASHINGTON STREET |
| 42 | 06430-0002 | 47 WOODBINE LANE |
| 43 | 06430-0002 | 43 WOODBINE LANE |

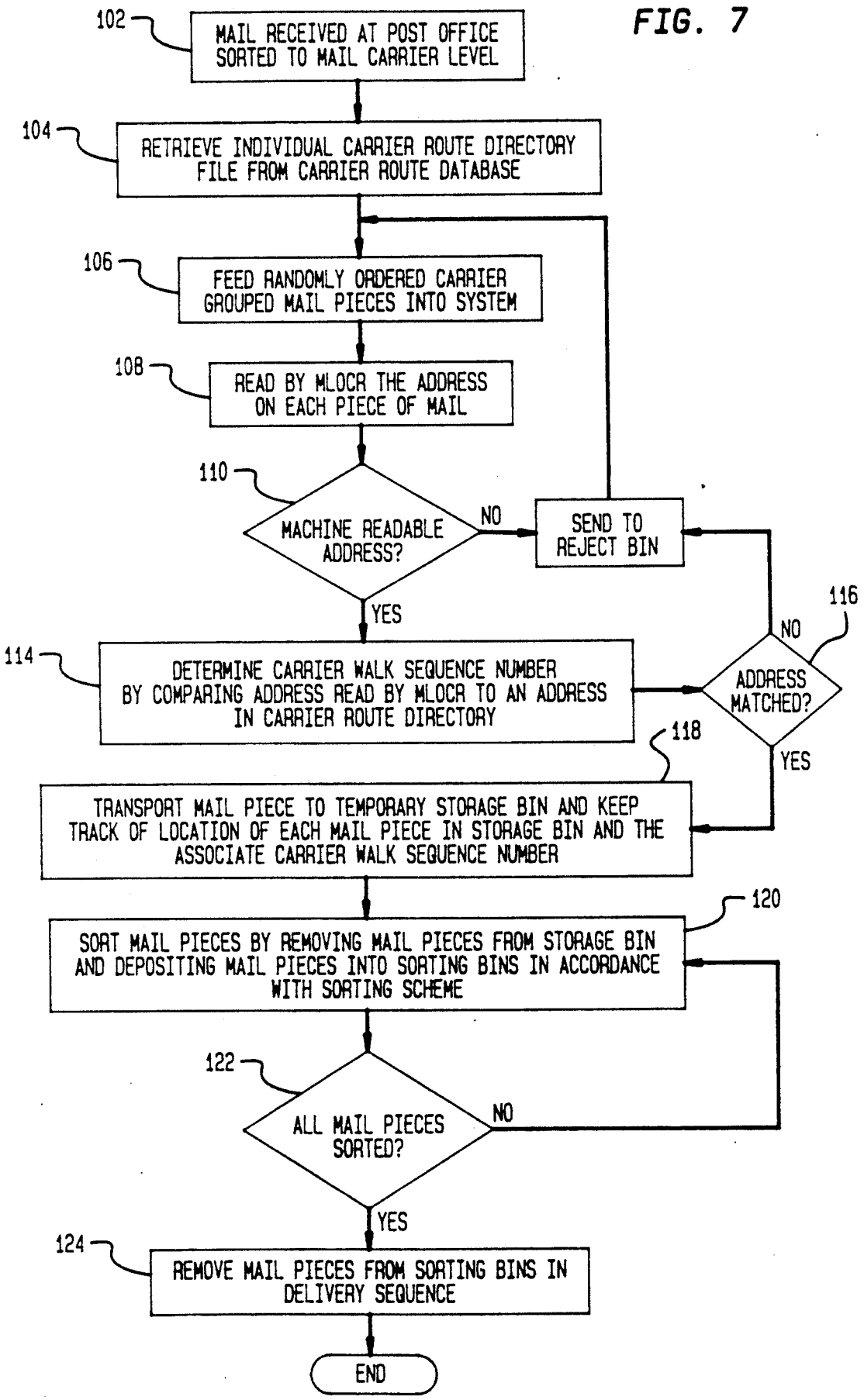
FIG. 7
102
MAIL RECEIVED AT POST OFFICE SORTED TO MAIL CARRIER LEVEL
104
RETRIEVE INDIVIDUAL CARRIER ROUTE DIRECTORY FILE FROM CARRIER ROUTE DATABASE
106
FEED RANDOMLY ORDERED CARRIER GROUPED MAIL PIECES INTO SYSTEM
108
READ BY MLOCR THE ADDRESS ON EACH PIECE OF MAIL
110
MACHINE READABLE ADDRESS?
NO
SEND TO REJECT BIN
YES
114
DETERMINE CARRIER WALK SEQUENCE NUMBER BY COMPARING ADDRESS READ BY MLOCR TO AN ADDRESS IN CARRIER ROUTE DIRECTORY
116
NO
ADDRESS MATCHED?
YES
118
TRANSPORT MAIL PIECE TO TEMPORARY STORAGE BIN AND KEEP TRACK OF LOCATION OF EACH MAIL PIECE IN STORAGE BIN AND THE ASSOCIATE CARRIER WALK SEQUENCE NUMBER
120
SORT MAIL PIECES BY REMOVING MAIL PIECES FROM STORAGE BIN AND DEPOSITING MAIL PIECES INTO SORTING BINS IN ACCORDANCE WITH SORTING SCHEME
122
ALL MAIL PIECES SORTED?
NO
YES
124
REMOVE MAIL PIECES FROM SORTING BINS IN DELIVERY SEQUENCE
END

SORTING SYSTEM FOR ORGANIZING IN ONE PASS RANDOMLY ORDER ROUTE GROUPED MAIL IN DELIVERY ORDER

RELATED APPLICATIONS

Reference is made to copending application of the same inventor, entitled "Sorting System For Organizing Randomly Ordered Route Grouped Mail In Delivery Order Sequence" U.S. Ser. No. 434,734, now U.S. Pat. No. 5,003,321 concurrently filed herewith and assigned to Pitney Bowes Inc.

FIELD OF THE INVENTION

This invention relates to a sorting system for use in arranging mail pieces according to a delivery sequence in a carrier's delivery route, commonly referred to as a "carrier walk sequence".

BACKGROUND OF THE INVENTION

The volume of mail handled on a daily basis by carriers, as for example, the U.S. Postal Service, is such that automated handling and sorting equipment is employed whenever and wherever possible to facilitate the distribution of mail pieces. Mail pieces include letters, flats, irregular parcel pieces, and parcels which are delivered by individual mail carriers. Various automated sorting techniques, systems and methods for processing mail are well known. Presently automated sorting systems can sort mail pieces down to an individual mail carrier at a local post office, commonly referred to as carrier route sorting. However, no automated sorting system exists that would provide a sort producing delivery sequenced mail, i.e., mail arranged to a carrier walk sequence. The term mail carrier, as used herein, refers to the person who delivers mail to residences and businesses within a local (city or rural) area.

Database files containing carrier route identification based on nine digit ZIP Codes, or ZIP+4, are used by the Postal Service in the automated carrier route sorting. The Postal Service makes the carrier route database files available to mailers, such as third class mailers. The mailers use the carrier route database files to print the mail pieces in a pre-sorted order according to carrier routes. The postal services in return provides a discount in postal rates for mailers delivering mail pieces in such a presorted order. Mail pieces sorted to a carrier route are in no particular order with regard to a carrier walk sequence.

Postal services use various sorting schemes and techniques. Presently in the United States, automated sorting down to a carrier walk sequence for a given carrier route does not exist for any kind or class of mail. The most recent automated system used by the U.S. Postal Service for receiving and sorting mail is a system utilizing an optical character reader/channel sorter (OCRCS). One of the functions normally performed by the OCRCS system is a primary sort based on the first two or three digits of a ZIP Code. Another function of the OCRCS system is to extract information from the mail piece and print the information on the mail piece in machine readable form. The information typically extracted is a nine digit ZIP Code, or ZIP+4. If the ZIP+4 is not printed on the mail piece, the OCRCS system can determine the ZIP+4 by recognizing the address printed on the mail piece and comparing the recognized address to information contained in a ZIP code database. Once the ZIP+4 is determined the OCRCS system prints the ZIP+4 in bar code form on the mail piece.

At the completion of the primary sorting, a secondary sort is performed on the mail pieces. Typically, the secondary sorting is done by a bar code sorter which reads and sorts by the ZIP+4 barcode printed by the OCRCS system. Based on the information contained in the ZIP+4, described below, the bar code sorter can sort to a carrier route level using the carrier route database files. Some mail pieces are rejected by the OCRCS system because the ZIP+4 cannot be determined, for example, mail pieces having handwritten addresses. Such mail pieces are handled by a multi position letter sorter machine, where operators enter information required for automated carrier route sorting.

The ZIP+4 provides information down to a carrier route level. The first five digits provide state, city and local post office identification. The +4 digits provide "block face" identification, i.e., sector and segment within a delivery area of a local post office. It can be appreciated that the ZIP+4 can be used to sort down to a mail carrier level using existing databases. It is understood that ZIP+4 does not contain enough information to allow a sort down to carrier walk sequence.

The final sorting of the mail pieces is to a carrier walk sequence. Generally, mail pieces delivered to a local post office for delivery to a final destination have already been sorted to a carrier route level. Mail pieces within each carrier route grouped mail are in no particular order. The sorting to a carrier walk sequence is usually performed by an individual mail carrier and is always done manually. The manual sorting technique used by the mail carrier is commonly referred to as "casing" the mail. The mail carrier takes each mail piece sorted to the carrier's route, reads a mailing address on the mail piece and places the mail piece into a "case", which is a piece of equipment containing many pigeonholes, in an order consistent with the order of the delivery stops on the carrier's route. The manual task of casing the mail is labor intensive, typically requiring three to four hours per day for each carrier route. This can be as much as one half of a mail carrier's work day. It can be appreciated that this manual method of reading the mailing address on each mail piece and then hand sorting each mail piece to a carrier walk sequence is subject to errors.

It is an object of the present invention to provide a system which would greatly improve the efficiency of sorting randomly ordered carrier route grouped mail pieces.

It is a further object of the present invention to reduce or eliminate the labor intensive hand sorting process by mail carriers at a local post office.

It is a another object of the present invention to shorten the time required to deliver mail by reducing the time required to process mail pieces in preparation for physical delivery and to avoid individual carrier handling errors while sorting in delivery order sequence.

SUMMARY OF THE INVENTION

It has been discovered that a carrier walk sequence database can be generated and utilized with a sorting system in a particular manner to achieve the above objectives for mail which has been processed down to a mail carrier route level, but which is still in random delivery order.

It has also been discovered that the capability of mail sorting equipment can be expanded by determining and keeping track of a delivery sequence for a mail piece as the mail piece is processed by the equipment for sorting to a carrier walk sequence.

According to the present invention, a one-pass sorting system is provided for sorting mail pieces in a sequence corresponding to a carrier walk sequence. The system includes storage media for storing a database containing a delivery sequence for each address on the carrier's route. Means are provided for feeding into the system the mail pieces to be delivered by the carrier and further means are provided for reading an address on each of the mail pieces. Means are operatively connected to the reading means and the storing means, for determining a sorting sequence representative of the carrier walk sequence for each of the mail pieces. Temporary storage means are operatively connected to the determining means storing the mail pieces until the sorting sequence has been determined for each of the mail pieces. Sort means operatively connected to the temporary storage means remove the mail pieces from the temporary storage means and deposit the mail pieces into sorting bins in accordance with the sorting sequence.

In accordance with a feature of the present invention means are provided for printing a sequence code corresponding to the sorting sequence representative of the carrier walk sequence on each of the mail pieces.

BRIEF DESCRIPTION OF THE DRAWINGS

A complete understanding of the present invention may be obtained from the following detailed description of the preferred embodiment thereof, when taken in conjunction with the accompanying drawings wherein like reference numerals designate similar elements in the various figures and, in which:

FIG. 6 is a sample directory relating to the carrier route of FIG. 5, helpful in understanding the present invention; and FIG. 7 is a flow chart of the sorting system for organizing randomly ordered route grouped mail into a carrier walk sequence.

DETAILED DESCRIPTION OF THE INVENTION

A typical individual mail carrier for the U.S. Postal Service has many stops in the delivery of mail along the carrier's route. The number of stops can vary extensively depending on the particular route and location of the route, e.g., urban, suburban or rural. For the purpose of the following description of the various figures, it is assumed that sorting to a carrier walk sequence will take place at a local post office and that the number of delivery stops for any mail carrier at the local post office will not exceed 400.

Figure 1:
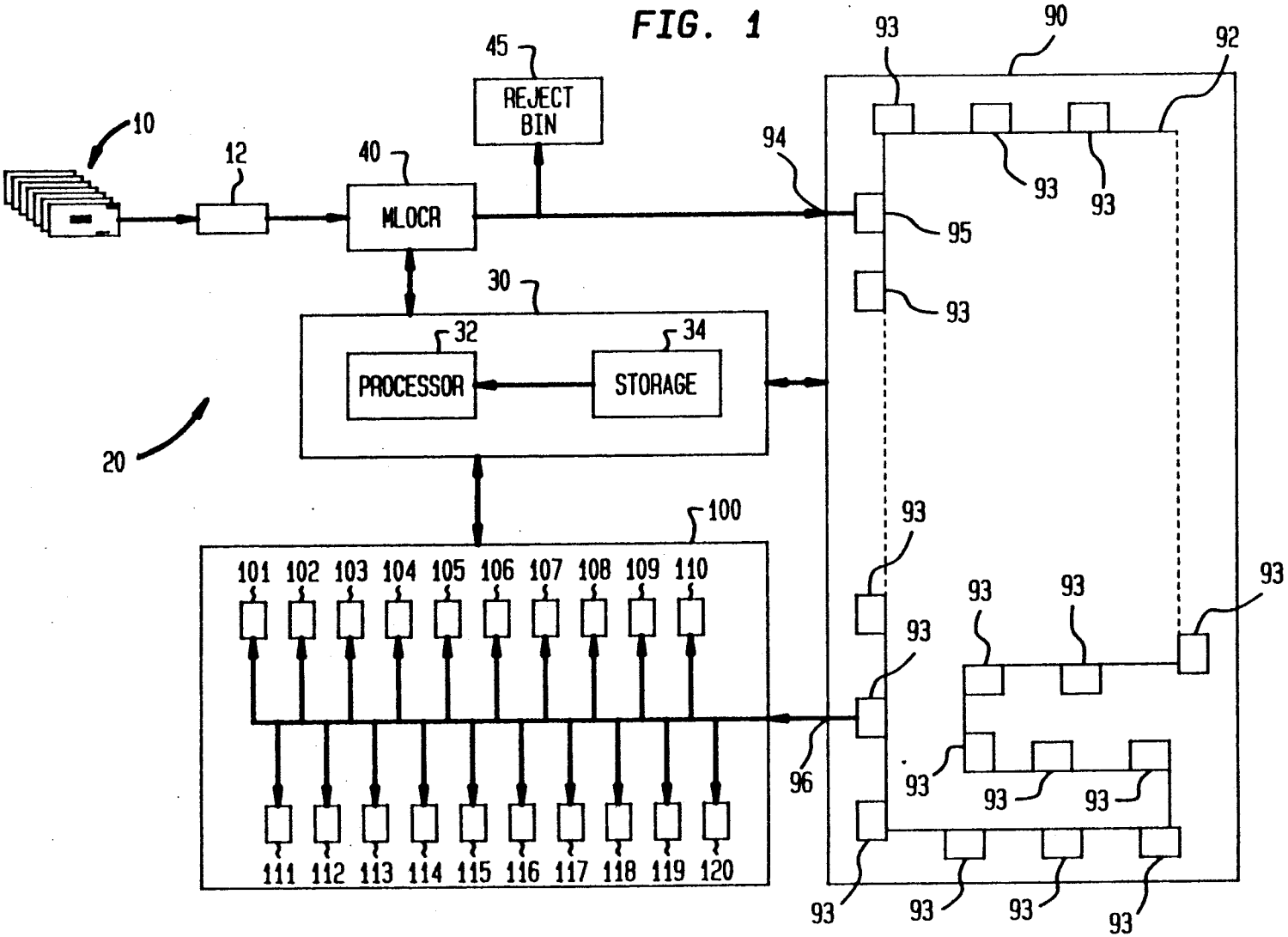
FIG. 1 is a diagrammatic representation of a sorting system for organizing randomly ordered carrier route grouped mail in carrier walk sequence, which embodies the present invention.

Referring now to FIG. 1, mail pieces 10 have been presorted in some manner, for example by the OCRCS system described above, and represent mail pieces to be delivered by one of the local mail carriers. Mail pieces 10 are in no particular order with respect to the carrier walk sequence of the mail carrier. When mail pieces 10 are received at the local post office, mail pieces 10 are fed into mail sorting system 20 which is controlled by computer system 30. Computer system 30 consists of processor 32 for controlling mail sorting system 20 and storage media 34 containing a carrier walk sequence database, described below, for various carrier routes of the local post office. Mail piece 12 represents one of mail pieces 10 transported through mail sorting system 20.

Figure 2A:
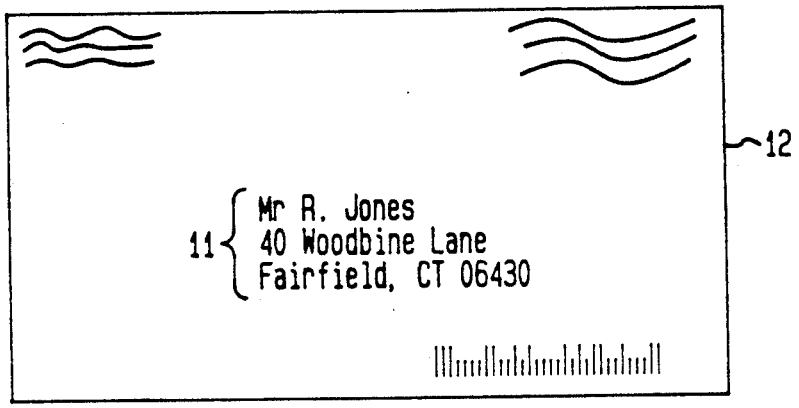
FIG. 2*a* shows the front side of a mail piece containing a mailing address and a bar code representing a nine digit ZIP code.

As mail piece 12 is transported past multiline optical character reader (MLOCR) 40, address 11 (FIG. 2*a*) printed on mail piece 12, if it is in machine readable form, is read and sent to processor 32. Processor 32 retrieves from storage media 34 a database file containing addresses of the mail steps on the carrier's route and corresponding delivery data such as carrier walk sequence numbers. Processor 32 determines the carrier walk sequence number for mail piece 12 by matching the address read by MLOCR 40 to an address in the database file. If the address on mail piece 12 is not in machine readable form, mail piece 12 is diverted into reject bin 45.

After the carrier walk sequence number for mail piece 12 has been determined, mail piece 12 is transported to temporary storage bin 90. Storage bin 90 is a large holding bin consisting of track 92 making a loop within storage bin 90, with a plurality of slots or receptacles 93 attached to track 92. Receptacles 93 are transported by the movement of track 92, effectively circulating within storage bin 90. The length of track 92 and the number of receptacles 93 are such that temporary storage bin 90 has the capacity to hold mail pieces for an entire mail route of any individual mail carrier. As mail piece 12 enters temporary storage bin 90, mail piece 12 is deposited into one of receptacles 93, for example receptacle 95, positioned at entry location 94 of storage bin 90. Track 92 moves until the next available receptacle is positioned at entry position 90. Processor 32 keeps track of both the location of receptacle 95 containing mail piece 12 and the previously determined carrier walk sequence number for mail piece 12. Mail piece 12 is transported within temporary storage bin 90 by receptacle 95. As track 92 moves within storage bin 90, receptacle 95 circulates within bin 90, continuously passing exit location 96 and entry location 94 of bin 90. At exit location 96, mail piece 12 either is removed from receptacle 95 and exits temporary storage bin 90 under the control of Processor 32 or remains in receptacle 95 and continues to circulate within storage bin 90.

Upon exiting storage bin 90, mail piece 12 is transported to sorting station 100 having a plurality of sorting bins, such as those at 101–120. The sorting occurs such that each of sorting bins 101–120 will first receive mail pieces having the highest carrier walk sequence number assigned to the bin. Processor 32, knowing receptacle 95 contains mail piece 12 and knowing the carrier walk sequence number of mail piece 12, causes mail piece 12 to be removed from receptacle 95 and exit temporary storage bin 90 at the appropriate time. Processor 32 also directs mail piece 12 to the one of sorting bins 100 having the carrier walk sequence number of mail piece 12 assigned to it. As mail piece 12 passes the one of sorting bins 101–120, for example, sorting bin 110, having an assigned carrier walk sequence number corresponding to the sequence code of mail piece 12, mail piece 12 is deposited into sorting bin 110.

In accordance with the preferred embodiment of the present invention, mail pieces 10 will be sorted in the following sequence. As mail pieces 10 containing carrier walk sequence numbers 20, 40, 60, 80 . . . 380, and 400 pass the exit location 96 of holding bin 90, such mail pieces will exit temporary storage bin 90 and will be directed to sorting bins 101, 102, 103, 104, . . . 119 and 120, respectively. After each of mail pieces 10 containing such sequence numbers have been sorted, processor 30 continues the sorting process by decrementing the carrier walk sequence number associated with the mail pieces to be sorted to each of the sorting bins. Therefore, mail pieces 10 containing route sequence numbers 19, 39, 59, 79, . . . 379 and 399 will be sorted to sorting bins 101, 102, 103, 104, . . . 119, and 120. This process continues until mail pieces containing sequence numbers 1, 21, 41, 61, . . . 361, and 381 are sorted to bins 101, 102, 103, 104, . . . 119 and 120. The sorting scheme for the preferred embodiment of the present invention is listed in Table 1. It will be understood that at any given time each of sorting bins 101–120 has only one carrier walk reference number assigned to it. It will be appreciated that a reverse sorting scheme would also provide a sort to the delivery sequence order.

When all mail pieces 10 have been sorted in accordance with the sort scheme listed in Table 1, the sorting bins 101–120 are all emptied in carrier walk sequence beginning with the mail pieces from bin 101 being followed in order by the mail pieces from bins 102 through 120.

The sort scheme listed in Table 1 applies to a sorting system handling 400 mail stops and having twenty sorting bins. It will be appreciated that the present invention can handle any combination in the amount of mail stops and sorting bins. The following is a general description of a sorting scheme for the preferred embodiment of the present invention. For X number of stops on a carrier's route and Y number of sorting bins, mail pieces having sequence codes of 1 through [X/Y] are deposited into bin 1, mail pieces having sequence codes of [X/Y]1 through 2 [X/Y] are deposited into bin 2. This sequence progression continues until mail pieces having sequence codes (Y−1) [X/Y] through X are deposited into bin Y. It will be understood by those skilled in the art that [X/Y] denotes the next highest integer to X/Y if X/Y is not an integer. For example if X=433 and Y=20, [X/Y]=22. This notation is known as a "ceiling".

It will be appreciated that the sorting process can begin immediately, i.e., it is not necessary that all mail pieces 10 have reached the temporary storage bin 90 before any mail pieces can be transported to the sorting bins 101–120. It will be understood that in maintaining correct sorting sequences it is necessary that all mail pieces have entered temporary storage bin 90 before the sorting process begins to decrement the sequence numbers assigned to the

TABLE I

EXIT SEQUENCE FROM MOLDING BIN

| BINS → | 101 | 102 | 103 | 104 | 105 | 106 | 107 | 108 | 109 | 110 | 111 |
|---|---|---|---|---|---|---|---|---|---|---|---|
| Sequence | | | | | | | | | | | |
| 1st | 20 | 40 | 60 | 80 | 100 | 120 | 140 | 160 | 180 | 200 | 220 |
| 2nd | 19 | 39 | 59 | 79 | 99 | 119 | 139 | 159 | 179 | 199 | 219 |
| 3rd | 18 | 38 | 58 | 78 | 98 | 118 | 138 | 158 | 178 | 198 | 218 |
| 4th | 17 | 37 | 57 | 77 | 97 | 117 | 137 | 157 | 177 | 197 | 217 |
| 5th | 16 | 36 | 56 | 76 | 96 | 116 | 136 | 156 | 176 | 196 | 216 |
| 6th | 15 | 35 | 55 | 75 | 95 | 115 | 135 | 155 | 175 | 195 | 215 |
| 7th | 14 | 34 | 54 | 74 | 94 | 114 | 134 | 154 | 174 | 194 | 214 |
| 8th | 13 | 33 | 53 | 73 | 93 | 113 | 133 | 153 | 173 | 193 | 213 |
| 9th | 12 | 32 | 52 | 72 | 92 | 112 | 132 | 152 | 172 | 192 | 212 |
| 10th | 11 | 31 | 51 | 71 | 91 | 111 | 131 | 151 | 171 | 191 | 211 |
| 11th | 10 | 30 | 50 | 70 | 90 | 110 | 130 | 150 | 170 | 190 | 210 |
| 12th | 9 | 29 | 49 | 69 | 89 | 109 | 129 | 149 | 169 | 189 | 209 |
| 13th | 8 | 28 | 48 | 68 | 88 | 108 | 128 | 138 | 168 | 188 | 208 |
| 14th | 7 | 27 | 47 | 67 | 87 | 107 | 127 | 137 | 167 | 187 | 207 |
| 15th | 6 | 26 | 46 | 66 | 86 | 106 | 126 | 136 | 166 | 186 | 206 |
| 16th | 5 | 25 | 45 | 65 | 85 | 105 | 125 | 135 | 165 | 185 | 205 |
| 17th | 4 | 24 | 44 | 64 | 84 | 104 | 124 | 134 | 164 | 184 | 204 |
| 18th | 3 | 23 | 43 | 63 | 83 | 103 | 123 | 133 | 163 | 183 | 203 |
| 19th | 2 | 22 | 42 | 62 | 82 | 102 | 122 | 132 | 162 | 182 | 202 |
| 20th | 1 | 21 | 41 | 61 | 81 | 10 | 121 | 131 | 161 | 181 | 201 |

| BINS → | 112 | 113 | 114 | 115 | 116 | 117 | 118 | 119 | 120 |
|---|---|---|---|---|---|---|---|---|---|
| Sequence | | | | | | | | | |
| 1st | 240 | 260 | 280 | 300 | 320 | 340 | 360 | 380 | 400 |
| 2nd | 239 | 259 | 279 | 299 | 319 | 339 | 359 | 379 | 399 |
| 3rd | 238 | 248 | 268 | 298 | 318 | 338 | 358 | 378 | 398 |
| 4th | 237 | 247 | 267 | 297 | 317 | 337 | 347 | 377 | 397 |
| 5th | 236 | 246 | 266 | 296 | 316 | 336 | 346 | 376 | 396 |
| 6th | 235 | 245 | 265 | 295 | 315 | 335 | 345 | 375 | 395 |
| 7th | 234 | 244 | 264 | 294 | 314 | 334 | 344 | 374 | 394 |
| 8th | 233 | 243 | 263 | 293 | 313 | 333 | 343 | 373 | 393 |
| 9th | 232 | 242 | 262 | 292 | 312 | 332 | 342 | 372 | 392 |
| 10th | 231 | 241 | 261 | 291 | 311 | 331 | 341 | 371 | 391 |
| 11th | 230 | 240 | 260 | 290 | 310 | 330 | 340 | 370 | 390 |

TABLE I-continued

| EXIT SEQUENCE FROM MOLDING BIN | | | | | | | | | |
|---|---|---|---|---|---|---|---|---|---|
| 12th | 229 | 239 | 259 | 289 | 309 | 320 | 339 | 369 | 389 |
| 13th | 228 | 238 | 258 | 288 | 308 | 319 | 338 | 368 | 388 |
| 14th | 227 | 237 | 257 | 287 | 307 | 318 | 337 | 367 | 387 |
| 15th | 226 | 236 | 256 | 286 | 306 | 316 | 336 | 366 | 386 |
| 16th | 225 | 235 | 255 | 285 | 305 | 315 | 335 | 365 | 385 |
| 17th | 224 | 234 | 254 | 284 | 304 | 314 | 334 | 364 | 384 |
| 18th | 223 | 233 | 253 | 283 | 303 | 313 | 333 | 363 | 383 |
| 19th | 222 | 232 | 252 | 282 | 302 | 312 | 332 | 362 | 382 |
| 20th | 221 | 231 | 251 | 281 | 301 | 311 | 331 | 351 | 381 |

sorting bins. In the preferred embodiment, mail pieces 10 containing sequence numbers 20, 40, 60, 80, . . . 400 can be sorted to bins 101–120 as soon as they pass exit location 96 in temporary storage bin 90. It will be understood that the sorting of mail pieces 10 containing sequence numbers 19, 39, 59, 79, . . . 399 cannot begin until all mail pieces 10 have received sequence numbers and mail pieces 10 containing sequence numbers 20, 40, 60, 80, . . . 100 have been sorted to bins 101–120.

It will be appreciated that the sorting of another mail carrier's mail pieces does not have to be delayed until the previous mail carrier's sort has been completed. In further expediting the sorting process, after one mail carrier's mail pieces have been read by MLOCR 40 and transported into storage bin 90, another mail carrier's mail pieces can be read into the system. Processor 30 has the capability to keep track of the location of more than one mail carrier's mail pieces in storage bin 90. The processor can distinguish between the various carriers automatically based on the information stored in the database used to determine the carrier walk sequence. Alternatively, an operator can manually distinguish the mail pieces of the various carrier by making an appropriate entry into the system prior to feeding each carrier's mail pieces.

Figure 3:
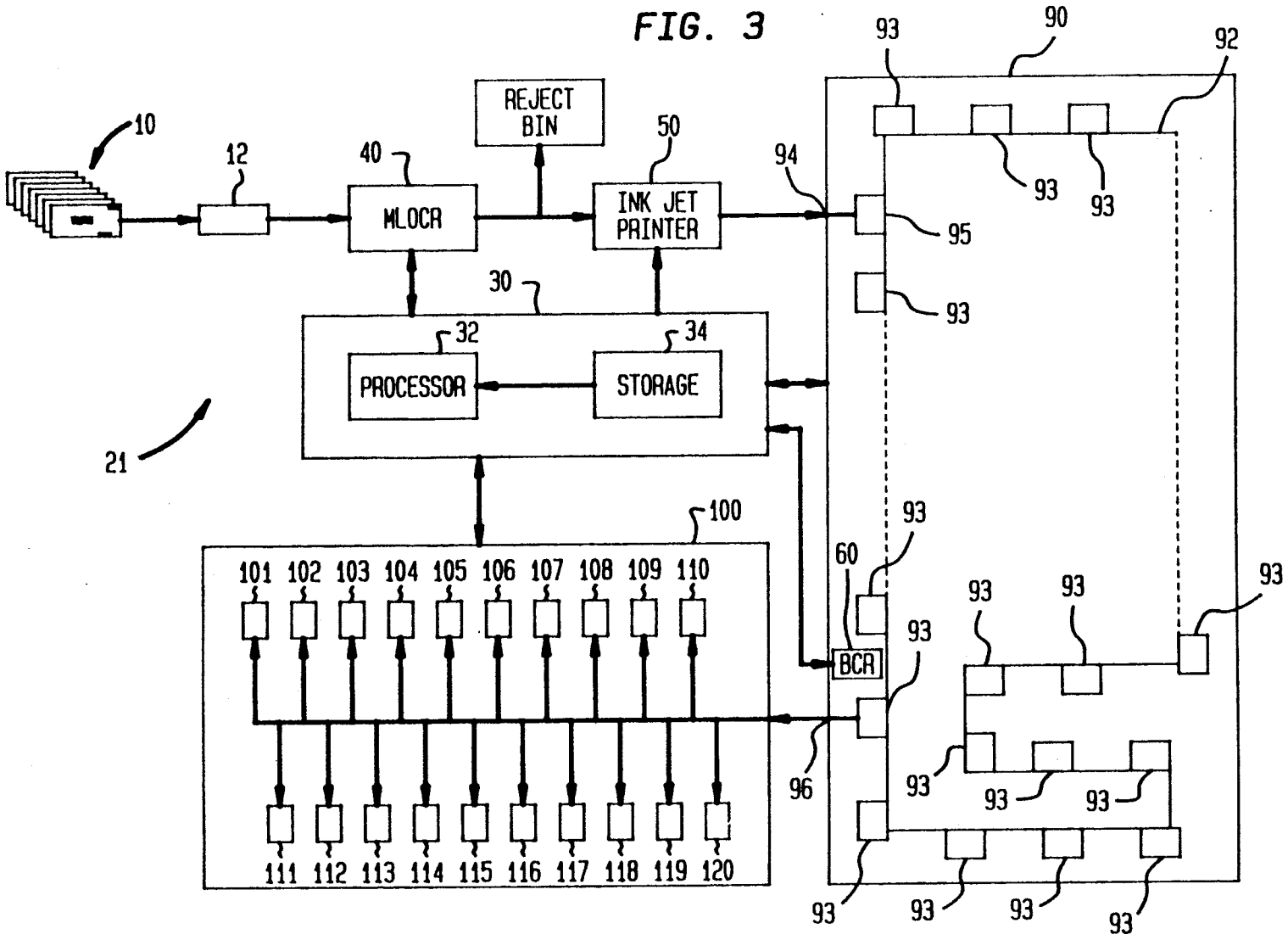
FIG. 3 is a diagrammatic representation of the sorting system in FIG. 1 with an ink jet printer and bar code reader added to the system to provide a back-up reference of the location of each mail piece.

Referring now to FIG. 3, enhanced sorting system 21 is shown. Ink jet printer 50 and bar code reader 60 have been added to provide a more reliable method of keeping track of mail pieces 10 after mail pieces 10 enter temporary storage bin 90. Unlike sorting system 20 in FIG. 1 which requires processor 30 to keep track of the location of each mail piece, mailing system 21 prints a carrier walk sequence code on each envelope using ink jet printer 50 and reads the sequence code at exit location 96 in storage bin 90 using bar code reader 60. It will be appreciated that this method of printing and reading the sequence code eliminates the possibility of processor 32 losing track of the location of the mail pieces such as after a power failure or shutdown of the system.

Figure 2B:
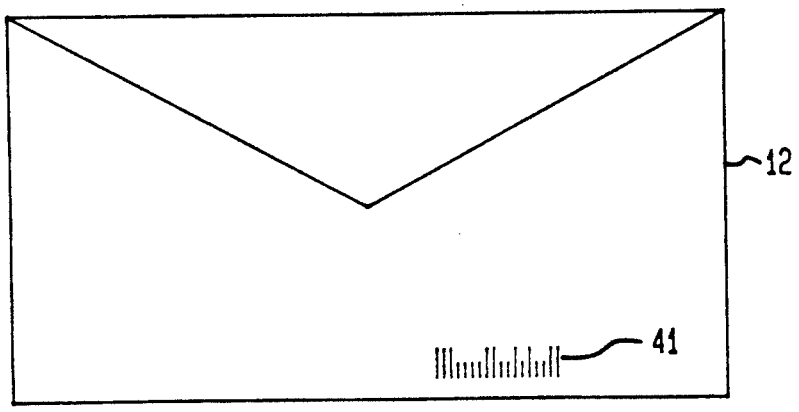
FIG. 2*b* shows the back side of a mail piece containing a bar code representing the delivery sequence code.

As mail piece 12 is transported to ink jet printer 50, an appropriate sequence code 41 (FIG. 2*b*) corresponding to the carrier walk sequence number is printed on mail piece 12. In the preferred embodiment of the present invention, sequence code 41 is a code, for example a three character code, representing the carrier walk sequence number and is printed in the form of a bar code on the back of mail piece 12. This facilitates the reading of the number in the temporary storage bin 90, as is explained in greater detail below, by bar code reader 60. Printing on the back of mail piece 12 provides an advantage in that it is easily distinguishable from any bar code printed by earlier sorting systems. It will be understood that the carrier walk sequence number could be printed in alpha numeric form on mail piece 12. This, however, would require an MLOCR in storage bin 90 instead of a less expensive and faster bar code reader. It will also be understood that more or less characters in the sequence code could be used, for example, a four character code could be used if more than one thousand stops are in any mail carrier's route. It will be appreciated that other printing than bar codes, such as dash codes, could be beneficially employed with the present system.

Bar code reader 60 reads bar code 41 on mail piece 12 passing by exit location 96 in storage bin 90. At any given time, mail pieces containing any one of twenty sequences codes assigned to sorting bins 101–120 are expected to exit sorting bin 90. When bar code reader 60 reads on mail piece 12 one of the sequence codes assigned to sorting bins 101–120, mail piece 12 is transported from the storage bin 90 and deposited into the one of sorting bins 101–120 assigned with the sequence code printed on mail piece 12.

Figure 4:
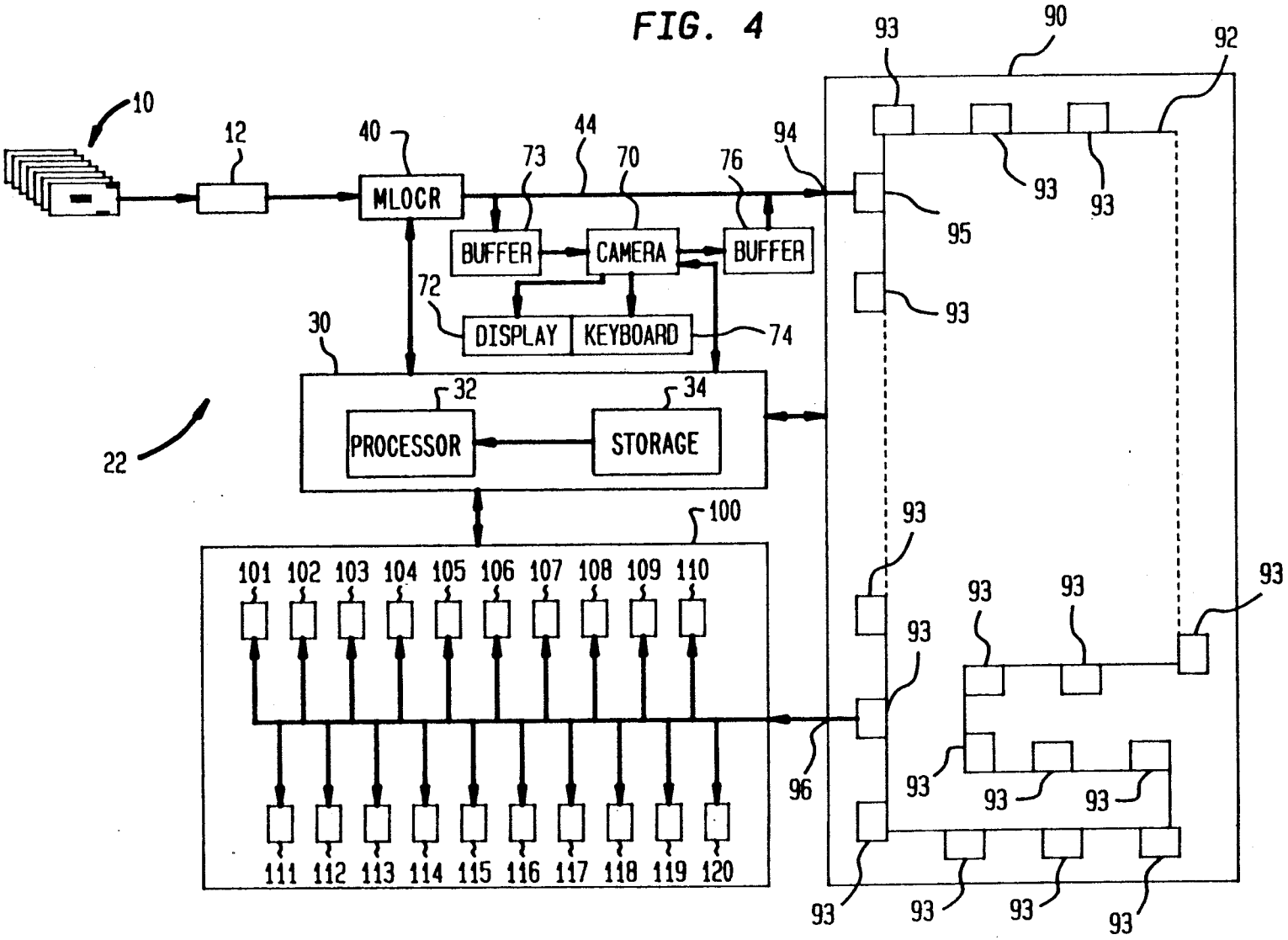
FIG. 4 is a diagrammatic representation of the sorting system in FIG. 1 with a camera, display and keyboard added to facilitate the processing of mail with non-machine readable addresses.

The only manual sorting remaining for an individual mail carrier is for the mail pieces which were not machine readable. Referring to FIG. 4, this manual process can be eliminated by replacing reject bin 45 (FIG. 1) with camera 70, display 72 and keyboard 74. In sorting system 22, when MLOCR 40 cannot read the address on mail piece 12, mail piece 12 is diverted to camera 70 which displays the address on display 72. An operator reads the address on display 72 and enters the address through keyboard 74. Using the address entered by the operator, processor 32 determines the sequence code in the same manner as if MLOCR 40 had read the address. This interactive method of handling non-machine readable addresses will not delay the reading of machine readable addresses by MLOCR 40 because the interactive processing of the mail piece having a non-machine readable address is performed off the main transport path 44. Once the sequence code is determined, the mail piece having the non-machine readable address is merged with the machine readable mail pieces on main transport path 44. Holding buffers 73 and 76 are for temporary storage of mail pieces diverted for the interactive processing described above. Buffer 73 holds diverted mail pieces waiting to be transported to camera 70. Buffer 76 holds mail pieces waiting to be merged onto main transport path 44.

Figure 5:
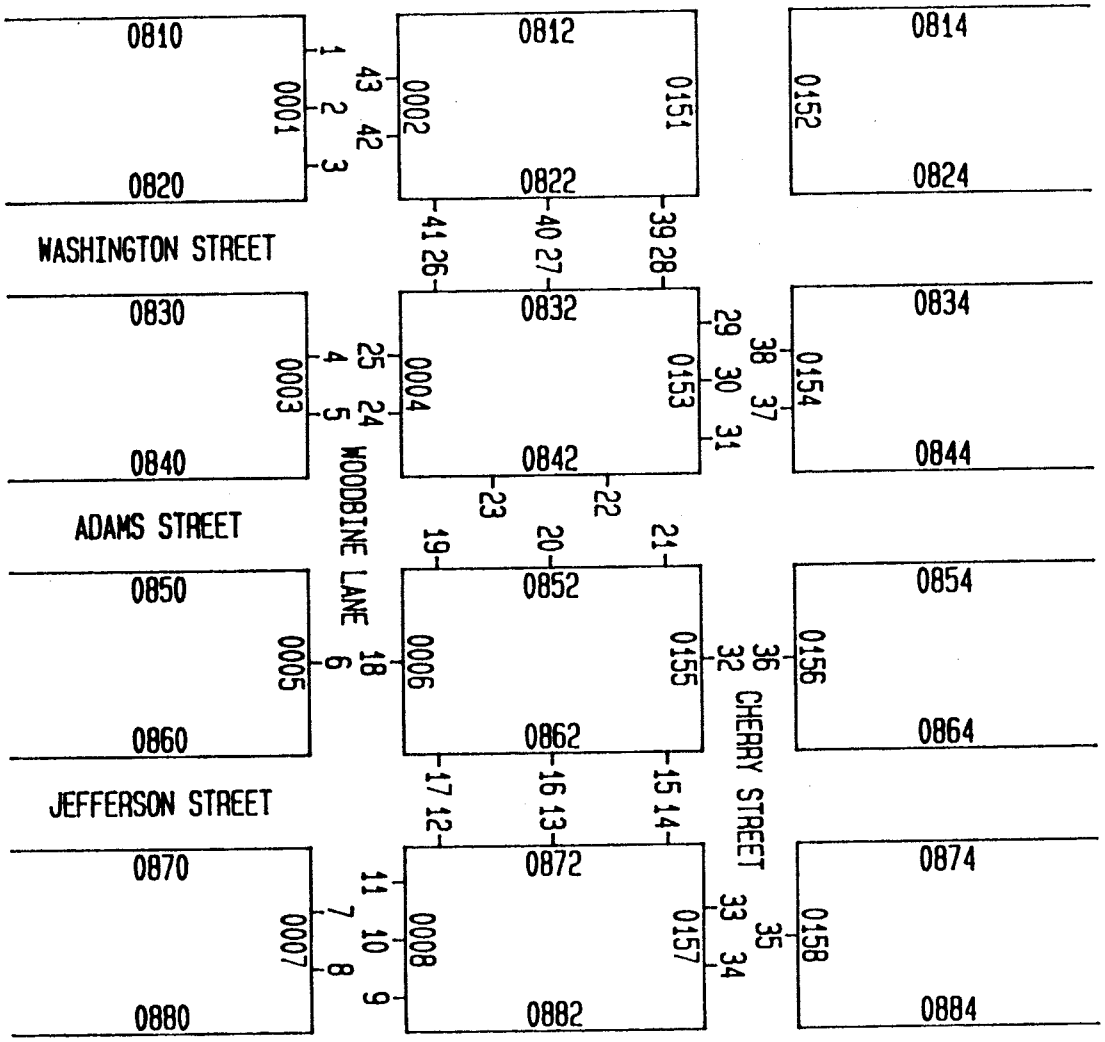
FIG. 5 is a diagram showing an example of a carrier walk sequence versus the last 4 digits of a nine digit ZIP Code.

Referring now to FIG. 5, a typical nine digit ZIP Code (ZIP+4) block face diagram is shown. The diagram illustrates a typical mail carrier walk sequence. The four digit number inside each block represents the "+4" part of the ZIP+4. The numbers 1 through 43 on the outside of each block represent the carrier walk sequence. It will be understood by those skilled in the art, that further sorting is required beyond the ZIP+4 sorting to obtain mail pieces sorted to the carrier walk sequence. As previously described, the nine digits in the ZIP+4 only contain enough information to sort down to a carrier route level. Additional information is needed to sort to a carrier walk sequence. The systems shown in FIGS. 1, 3 and 4 process the mail so that further sorting to a carrier walk sequence can be obtained.

Referring now to FIG. 6, an example of one form of file containing the directory for the mail carrier walk sequence illustrated in FIG. 5 is shown. It will be appreciated from FIG. 6 that because there is no correlation between the ZIP+4 number and the carrier walk sequence, a further sort using the entire address is required.

In FIG. 7, a flow chart describing a one pass sorting system of the preferred embodiment of the present invention is shown. At block 102, mail pieces sorted to mail carrier level are received at a local post office. At block 104, the carrier route directory file is retrieved from a carrier route database. At block 106, randomly ordered carrier grouped mail pieces are fed into the sorting system. At block 108, the address on each mail piece is read by an MLOCR. At block 110, if the address is not in machine readable form the mail piece is diverted to the reject bin at block 112. If the address is machine readable, at block 114, determine the carrier walk sequence number for the mail piece by comparing the address read by the MLOCR to an address in the carrier route directory. At block 116, if the MLOCR read address does not match any address in the directory, divert the mail pieces to the reject bin at block 112. If a match is found, at block 118 transport the mail piece to the temporary storage bin keeping track of the location of the mail piece in the storage bin and the associated carrier walk sequence number. At block 120, the mail pieces are sorted by removing the mail pieces from the storage bin and depositing the mail pieces into the sorting bins in accordance with a sorting scheme. At block 122, if all mail pieces have not been sorted continue to sort at block 120. If all mail pieces have been sorted, at block 124, remove the sorted mail pieces from the sorting bins in delivery sequence.

It is therefore, evident that there has been provided in accordance with the present invention a sorting system for organizing mail in the delivery order sequence that fully satisfies the object, aims and advantages set forth above. While this invention has been described in conjunction with specific embodiments thereof, many alternative, modifications and variations will be apparent to those skilled in the art. Accordingly, it is intended to embrace all such alternative, modifications and variations that follow within the spirit and scope of the appended claims.

What is claimed is:

1. A system for sorting mail pieces for delivery by a mail carrier in a sequence corresponding to the mail carrier's route comprising:

a. means for storing a database containing a delivery sequence for each address on the carrier's route;

b. means for feeding the mail pieces to be delivered by the carrier;

c. means coupled to the feeding means for reading an address on each of said fed mail pieces;

d. means, operatively connected to said reading means and said storing means, for determining a sorting sequence representative of said delivery sequence for each of the mail pieces;

e. temporary storage means operatively connected to said determining means for temporarily storing the mail pieces until said sorting sequence has been determined for each of the mail pieces; and sort means operatively connected to said temporary storage means for removing the mail pieces from said temporary storage means and depositing the mail pieces into a plurality of sorting bins in accordance with said sorting sequence.

2. A system for sorting mail pieces in accordance with claim 1 wherein said reading means reads the address of each mail pieces containing a machine readable address.

3. A system for sorting mail pieces in accordance with claim 2 further comprising means for rejecting mail pieces not containing said machine readable address.

4. A system for sorting mail pieces in accordance with claim 1 further comprising means for printing a sequence code corresponding to said sorting sequence representative of said delivery sequence on each of the mail pieces.

5. A system for sorting mail according to claim wherein said sequence code is printed in the form of a bar code.

6. A system for sorting mail pieces in accordance with claim 4 said sort means further comprising a sequence code reading means for reading said sequence code printed on each of the mail pieces.

7. A system for sorting mail according to claim 6 wherein said sequence code reading means is a bar code reader.

8. A system for sorting mail pieces in accordance with claim 4 wherein said sort means sorts in the following order, where X equals number of stops on the carrier's route and Y equals number of sorting bins in the sorting system: mail pieces having said sequence codes of 1 through [X/Y] are deposited into bin 1, mail pieces having sequence codes [X/Y]+1 through 2[X/Y] are deposited into bin 2, and mail pieces having sequenced codes (Y−1)[X/Y]+1 through X are deposited into bin Y.

9. A method for sorting mail in a sequence corresponding to a mail carrier's route, comprising the steps of:

a) storing a database containing a delivery sequence for each address on the carrier's route;

b) reading in a random order the address on each mail piece received at a local office for delivery by the carrier;

c) comparing said read address of each piece of mail to addresses contained in said database;

d) determining the delivery order sequence by the carrier for each mail piece;

e) storing the mail pieces in a temporary storage bin until the delivery order sequence is determined for each mail piece;

f) sorting each mail piece in accordance with said delivery order sequence;

g) depositing the sorted mail pieces into sorting bins in accordance with delivery order sequence sorting scheme.

10. A method for sorting mail in a sequence corresponding to a mail carrier's route, comprising the steps of:

a) storing a database containing a delivery sequence for each address on the carrier's route;

b) reading in a random order the address on each mail piece received at a local office for delivery by the carrier;

c) comparing said read address of each piece of mail to addresses contained in said database;

d) determining the delivery order sequence for each mail piece and assigning each mail piece to one of a plurality of sorting bins in accordance to the delivery order sequence;

e) storing the mail pieces in a temporary storage bin;

f) removing from the temporary storage bin each mail piece having a particular delivery order sequence corresponding to one of the delivery order sequences to be deposited first into each of the sorting bins and sorting said mail piece with said particular delivery order sequence into the corresponding sorting bin;

g) removing the remaining mail pieces after the sequence code is determined for each mail piece and sorting the remaining mail pieces into said sorting bins in accordance with said delivery order sequence.

* * * * *